US007421868B2

(12) United States Patent
Matyko et al.

(10) Patent No.: US 7,421,868 B2
(45) Date of Patent: Sep. 9, 2008

(54) ENHANCED EXTENDABLE MULTIPOINT LOCK

(75) Inventors: Adalbert Matyko, Ashdod (IL); Alex Akerman, Beer Sheva (IL)

(73) Assignee: Mul-T-Lock Technologies Ltd., Yavne (IL)

( * ) Notice: Subject to any disclaimer, the term of this patent is extended or adjusted under 35 U.S.C. 154(b) by 0 days.

(21) Appl. No.: 10/553,059

(22) PCT Filed: Mar. 9, 2004

(86) PCT No.: PCT/IL2004/000229

§ 371 (c)(1),
(2), (4) Date: Oct. 24, 2006

(87) PCT Pub. No.: WO2004/083575

PCT Pub. Date: Sep. 30, 2004

(65) Prior Publication Data

US 2007/0084258 A1 Apr. 19, 2007

(30) Foreign Application Priority Data

Mar. 19, 2003 (IL) ..... 154990
Jun. 8, 2003 (IL) ..... 156342

(51) Int. Cl.
*E05B 63/14* (2006.01)
*E05B 59/00* (2006.01)

(52) U.S. Cl. ..... 70/120; 70/118; 70/108; 70/201; 292/39

(58) Field of Classification Search ..... 70/201, 70/202, 120, 117, 118, 108, 113, 114, 129, 70/109; 292/39, 142; 417/393; 49/449
See application file for complete search history.

(56) References Cited

U.S. PATENT DOCUMENTS

| | | | | | |
|---|---|---|---|---|---|
| 2,125,227 | A | * | 7/1938 | Hammarle | 70/118 |
| 3,670,537 | A | * | 6/1972 | Horgan, Jr | 70/120 |
| 4,037,440 | A | * | 7/1977 | Shabtai et al. | 70/108 |
| 4,282,769 | A | * | 8/1981 | Sandrock | 74/473.23 |
| 4,297,914 | A | * | 11/1981 | Klem et al. | 74/532 |
| 4,362,034 | A | * | 12/1982 | Amgar | 70/108 |
| 4,432,573 | A | * | 2/1984 | Goldman | 292/37 |
| 4,476,700 | A | * | 10/1984 | King | 70/99 |
| 5,324,876 | A | * | 6/1994 | Rigby | 585/360 |
| 5,338,875 | A | * | 8/1994 | DeCamp et al. | 556/402 |
| 5,339,659 | A | * | 8/1994 | Guzzinati | 70/120 |
| 5,388,875 | A | * | 2/1995 | Fleming | 292/37 |

(Continued)

FOREIGN PATENT DOCUMENTS

DE 2252177 5/1974

(Continued)

*Primary Examiner*—Patricia Engle
*Assistant Examiner*—Alyson M Merlino
(74) *Attorney, Agent, or Firm*—Nixon & Vanderhye P.C.

(57) ABSTRACT

A multipoint lock including a locking mechanism adapted to selectively retract and extend at least one locking element relative to an elongate housing, wherein the locking mechanism includes an arm pivotally attached to a lock actuator and constrained to travel in a channel formed in a linkage device linked to the at least one locking element, and wherein in a first position of the lock actuator, the arm is at a first limit of travel in the channel and is pivoted in a first angular direction with respect to the lock actuator so as to be geometrically locked at the first limit of travel.

5 Claims, 9 Drawing Sheets

U.S. PATENT DOCUMENTS 5,709,111 A * 1/1998 Henao ..... 70/104
5,992,188 A * 11/1999 Saunders ..... 70/120

FOREIGN PATENT DOCUMENTS

DE 3834373 4/1990
EP 0560017 9/1993
EP 1061215 12/2000
EP 1061215 A2 * 12/2000
GB 2294085 4/1996
WO WO 0129353 4/2001
WO WO0129353 A1 * 4/2001

* cited by examiner

ENHANCED EXTENDABLE MULTIPOINT LOCK

REFERENCES TO RELATED APPLICATIONS

This application is the US national phase of international application PCT/IL04/000229 filed 9 Mar. 2004 which claims benefit of Israel Patent Application Nos. 154990 filed 19 Mar. 2003 and 156342 filed 8 Jun. 2003, the entire contents of both of which applications are incorporated by reference.

The present invention relates generally to multipoint locks, and particularly to multipoint locks with geometric locking, and which may have locking elements that may extend from the lock at more than one length.

BACKGROUND OF THE INVENTION

Lock assemblies for use with doors or windows, hinged or sliding, are well known in the art. Such lock assemblies typically include one or more movable lock members mounted at a vertical position along a free side edge of the door or window in close proximity with an actuator positioned for convenient manual operation. A handle or lever is normally included as part of the lock assembly and is adapted for manual rotation to retract the latch bolt and thereby permit the door or window to be opened.

Although door/window lock assemblies of the general type described above have performed their latching and/or locking functions in a generally satisfactory manner, there is a continuous need for further improvements in high security lock assemblies designed to safely and positively lock a door/window against unauthorized entry. Toward this end, so-called multipoint lock assemblies have been proposed with multiple lock members provided along the door/window side edge for engaging a corresponding number of keeper plates mounted on the adjacent door/window jamb. Generally the multipoint lock assembly is fashioned as an elongate member with locking elements that may be thrown at the ends of the assembly.

U.S. Pat. No. 6,282,929 to Eller et al. describes a multipoint mortise lock assembly that includes an extended face piece mounted flush along the edge of a door, a mortise lock connected to the face piece, and a pair of hook bolt latch mechanisms mounted to the face piece above and below the mortise lock. An elongated actuator, which is preferably a flat rod slidingly mounted to the back of the face piece, acts to extend and retract the hook bolts in synchronism with a deadbolt in the mortise lock. The actuator is connected between a deadbolt arm in the mortise lock, which drives the deadbolt, and the hook bolt latch mechanisms. The deadbolt arm is driven conventionally, such as by a key or a thumb latch, and the design allows one hand operation of the multipoint mortise lock assembly. This assembly is basically used for a hinged door.

U.S. Pat. No. 5,373,716 to MacNeil, et al. describes another kind of multipoint lock assembly for use with a hinged or swinging door. This multipoint door lock assembly includes a plurality of latch pins for securing the door in a tightly closed condition. The multiple latch pins are adapted for coordinated operation from a single or main actuator, in combination with a security deadbolt and a related panic release mechanism for quickly and easily unlocking and opening the door from the inside.

Multipoint lock assemblies that include geometric locking of locking members are also known. By "geometric locking" it is meant that a portion of the locking member moves in a channel, groove or similar passage, and at some point is prevented from moving further in the channel at least partially by a geometric shape or arrangement of the channel with respect to the locking member. For example, British Patent GB 2229488 to ABT Hardware Ltd. describes a multipoint lock that has a main unit and at least one auxiliary unit coupled by an actuating member which is operated by an operating member of the main unit to cause a locking element of the auxiliary unit to move between unlocked and locked positions. The auxiliary unit comprises an actuating mechanism that includes a drive transmission element to transmit drive from the actuating member to the locking element. The actuating member may be moved to bring the drive transmission element from a first, unlocked position to a second, locked position. Afterwards, further movement of the actuating member may geometrically lock the drive transmission element in its second, locked position.

SUMMARY OF THE INVENTION

The present invention seeks to provide an improved multipoint lock with geometric locking, and which may have locking elements that may extend from the lock at more than one length, as described more in detail hereinbelow.

There is thus provided in accordance with an embodiment of the present invention a multipoint lock comprising a locking mechanism adapted to selectively retract and extend at least one locking element relative to an elongate housing, wherein the locking mechanism comprises an arm pivotally attached to a lock actuator and constrained to travel in a channel formed in a linkage device linked to the at least one locking element, and wherein in a first position of the lock actuator, the arm is at a first limit of travel in the channel and is pivoted in a first angular direction with respect to the lock actuator so as to be geometrically locked at the first limit of travel. In a second position of the lock actuator, the arm may be at a second limit of travel in the channel and may be pivoted in a second angular direction with respect to the lock actuator so as to be geometrically locked at the second limit of travel. In the first position of the lock actuator, the locking element may be in an extended, locked position relative to the elongate housing, whereas in the second position of the lock actuator, the at least one locking element may be in a retracted, unlocked position relative to the elongate housing.

In accordance with an embodiment of the present invention the lock actuator comprises a cylinder lock in meshed engagement with a toothed rack, wherein the arm is pivotally attached to the toothed rack.

Further in accordance with an embodiment of the present invention the linkage device comprises a stationary linkage element with a first channel formed therein and a movable linkage element with a second channel formed therein, the movable linkage element being linked to the at least one locking element, and the arm being received in both the first and second channels. The first channel may be arcuate and the second channel may be generally straight.

There is also provided in accordance with an embodiment of the present invention a multipoint lock comprising a locking mechanism adapted to selectively retract and extend at least one locking element relative to an elongate housing, wherein the locking mechanism comprises an arm pivotally attached to a lock actuator and constrained to travel in a channel formed in a linkage device linked to the at least one locking element, wherein the channel comprises at least two terminuses at which the arm is in a locked position and the at least one locking element is at an extended position protruding out of the elongate housing, wherein the at least one locking element extends further out of the elongate housing with the arm at one of the terminuses than at another of the terminuses.

In accordance with an embodiment of the present invention the terminuses of the channel comprise an inner terminus, at least one intermediate terminus and an outer terminus, the outer terminus being closer to an end of the elongate housing than the inner terminus.

Further in accordance with an embodiment of the present invention a blocking element is attached to the linkage device, the blocking element comprising a first position in which the blocking element permits the arm to travel between the inner terminus and the at least one intermediate terminus, and blocks travel of the arm beyond the at least one intermediate terminus to the outer terminus. The blocking element may comprise a second position in which the blocking element permits the arm to travel between the inner terminus and the outer terminus, and blocks travel of the arm between the inner terminus and the at least one intermediate terminus.

Still further in accordance with an embodiment of the present invention the arm is geometrically locked at a position along the channel, such as one or more of the terminuses.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
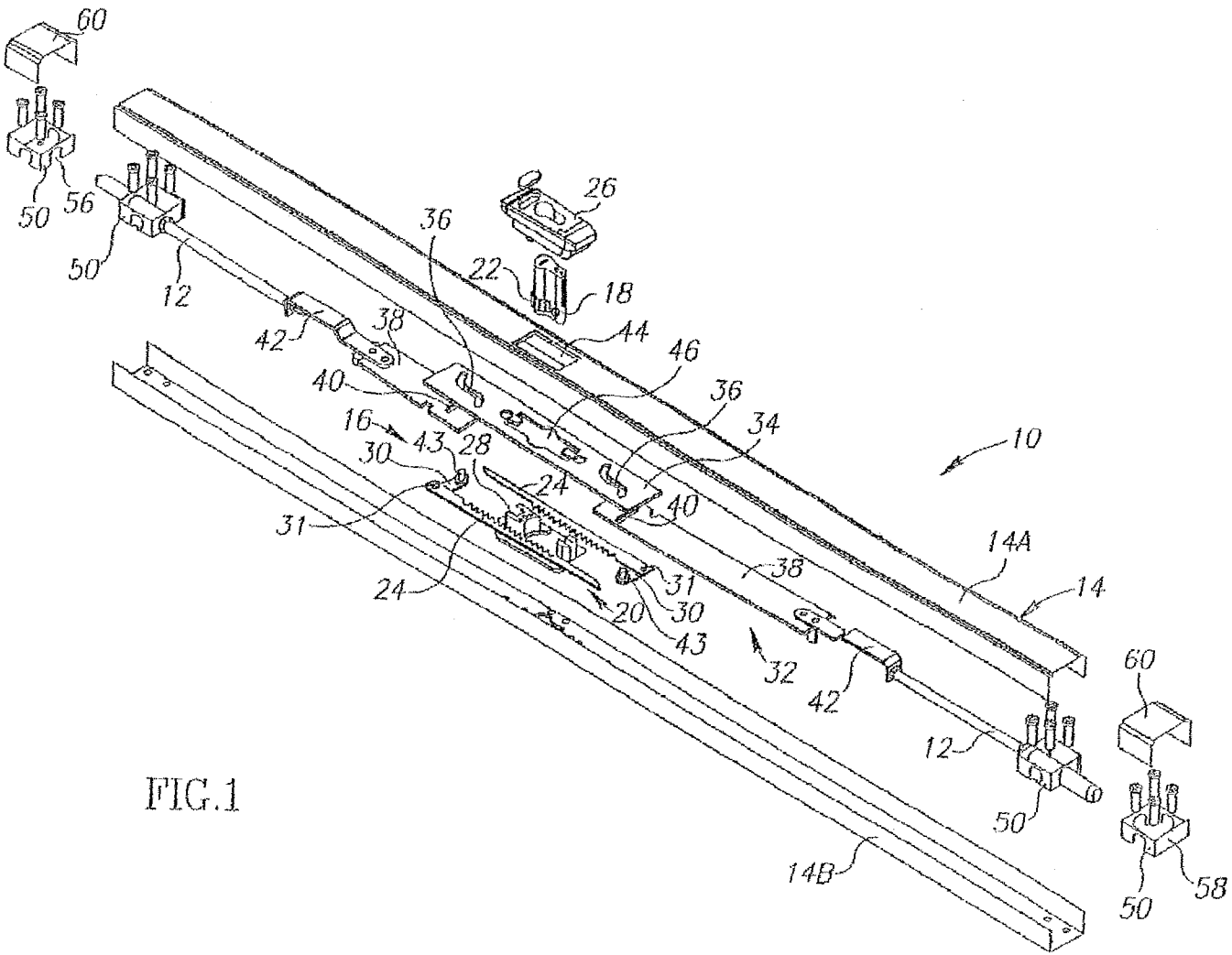
FIG. 1 is a simplified exploded illustration of a multipoint lock, constructed and operative in accordance with an embodiment of the present invention.

Reference is now made to FIG. 1, which illustrates a multipoint lock 10, constructed and operative in accordance with an embodiment of the present invention.

Multipoint lock 10 may comprise one or more locking elements 12, which may be selectively retracted and extended relative to an elongate housing 14 by means of a locking mechanism 16. Housing 14 may be constructed, without limitation, from two halves 14A and 14B, which may be made of sheet metal or plastic, for example.

Locking mechanism 16 may comprise a cylinder lock 18 that cooperates with a lock actuator 20 to retract or extend the locking elements 12. In the illustrated embodiment, cylinder lock 18 may comprise a gear wheel 22 that meshes with a pair of toothed racks 24 of lock actuator 20. Cylinder lock 18 may be protected by a cylinder guard 26 and may be mounted on a mounting block 28 secured to an inner surface of elongate housing 14.

An arm 30 may be pivotally attached to each toothed rack 24 of lock actuator 20 at a pivot 31. Arm 30 may be constrained to travel in a channel formed in a linkage device 32 linked to locking elements 12. In the illustrated embodiment, linkage device 32 may comprise a stationary linkage element 34 with a pair of first channels 36 formed therein, and a pair of movable linkage elements 38, each with a second channel 40 formed therein. The movable linkage elements 38 may be linked to locking elements 12 by means of brackets 42. A pin 43 of arm 30 may be received in both first and second channels 36 and 40. First channel 36 may be arcuate, while second channel 40 may be generally straight. Cylinder lock 18 may pass through openings 44 and 46 formed in housing half 14A and stationary linkage element 34, respectively. Housing half 14A serves as a cover for elongate housing 14.

Locking elements 12 may be arranged to pass through end guides 50, which are illustrated more in detail in FIGS. 2A-2D, to which reference is now additionally made. Each end guide 50 may be formed with first and second apertures 52 and 54, respectively, which are mutually spaced apart. A third aperture 56 may be angled with respect to (e.g., perpendicular to) first and second apertures 52 and 54. Third aperture 56 is formed on a face of end guide 50 parallel to another face 58 that prevents passage therethrough of locking element 12. In FIG. 1, end guides 50 are mounted in elongate housing 14 in a first orientation wherein the locking elements 12 are arranged to pass all the way through first and second apertures 52 and 54 and protrude out of end guides 50 (this being the orientation shown in FIGS. 2C and 2D). In this orientation, first and second apertures 52 and 54 are aligned with a longitudinal axis of elongate housing 14. End guides 50 may be secured to housing half 14B with mounting screws or other suitable hardware, and may be covered by housing half 14A.

Figure 2C:
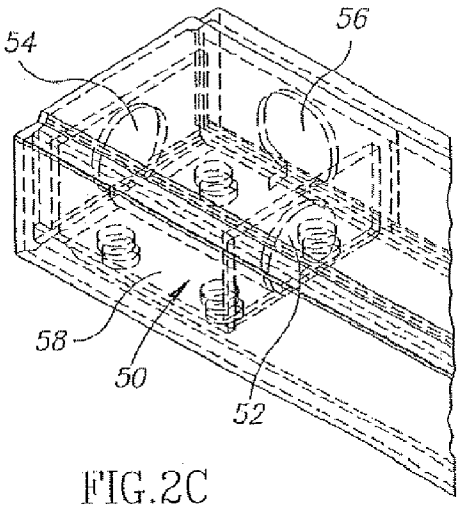
FIGS. 2C and 2D are simplified perspective and front-view illustrations, respectively, of the end guide of the multipoint lock of FIG. 1, wherein the end guide is mounted inside the multipoint lock and the locking element can pass all the way through the end guide.
Figure 2A:
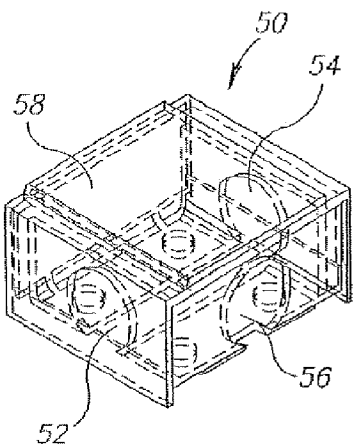
FIGS. 2A and 2B are simplified perspective and front-view illustrations, respectively, of an end guide of the multipoint lock of FIG. 1, wherein the end guide is mounted outside the multipoint lock onto a mounting structure (e.g., a door jamb or window frame), wherein a locking element cannot pass through the end guide.
Figure 2D:
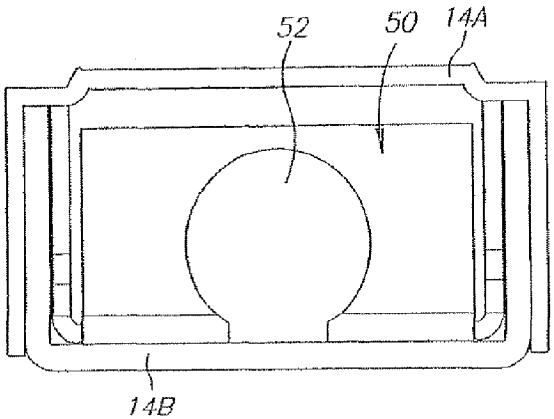
Figure 2B:
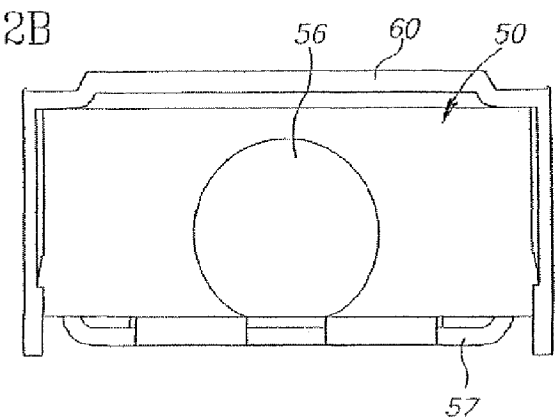

In FIG. 1, another pair of end guides 50 are mounted outside of elongate housing 14 to a mounting structure 57 (shown in FIG. 2B, such as on a door jamb or window frame, for example) in a second orientation wherein the locking elements 12 are arranged to pass through third aperture 56 but do not protrude out of the end guides 50 (this being the orientation shown in FIGS. 2A and 2B). In this orientation, third aperture 56 is aligned with the longitudinal axis of elongate housing 14. Each end guide 50 may comprise a cover 60.

Thus end guides 50 may be used inside or outside elongate housing 14, depending on the orientation of apertures 52, 54 and 56.

Figure 3:
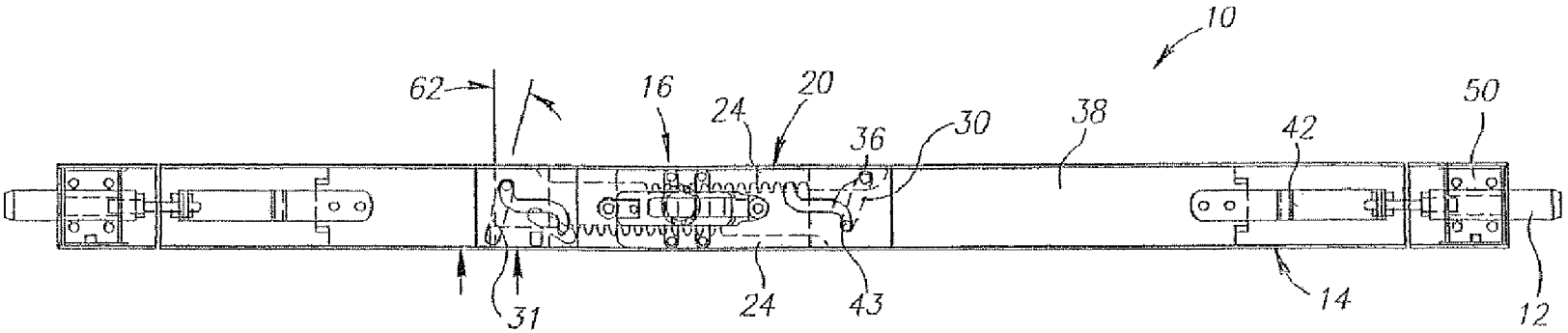
FIG. 3 is a simplified plan view illustration of the multipoint lock of FIG. 1, wherein a locking mechanism is in an extended position and is geometrically locked at a first limit of travel.
Figure 4:
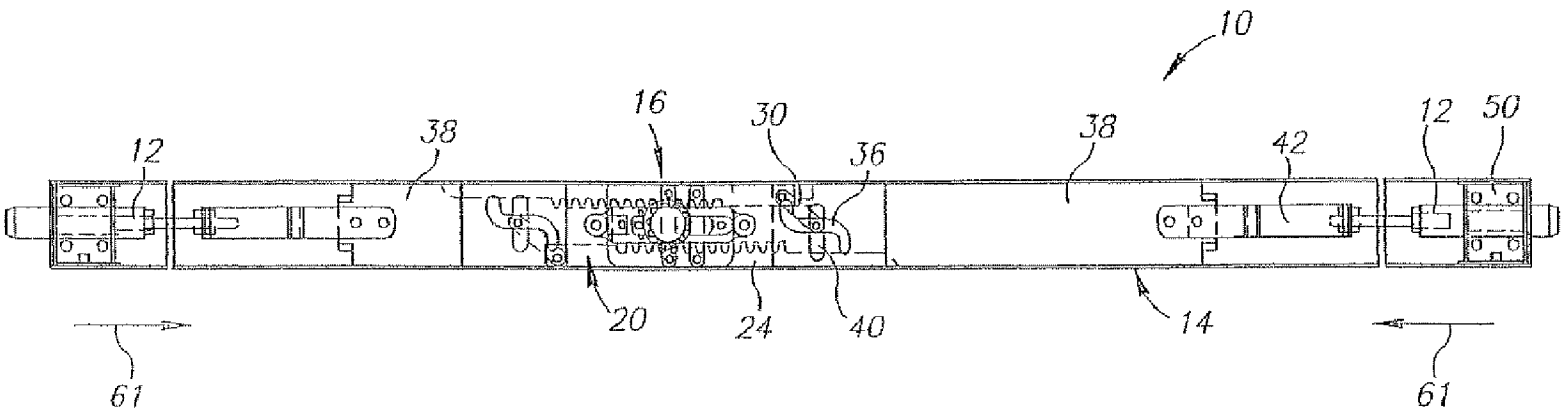
FIG. 4 is a simplified plan view illustration of the multipoint lock of FIG. 1, showing the locking mechanism in an intermediate position.
Figure 5:
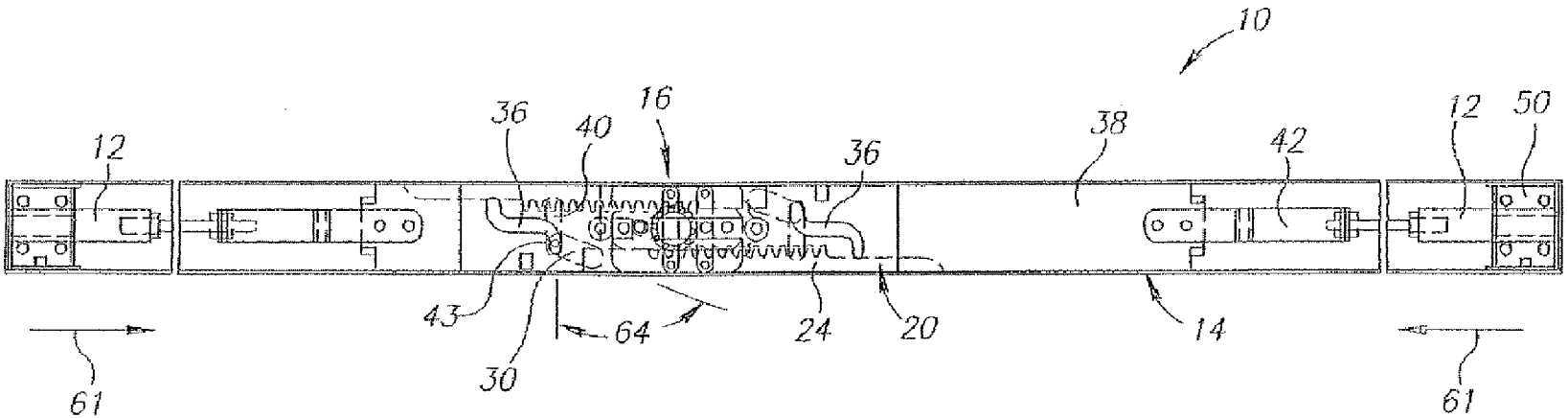
FIG. 5 is a simplified plan view illustration of the multipoint lock of FIG. 1, wherein the locking mechanism is in a retracted position and is geometrically locked at a second limit of travel.

Reference is now made to FIGS. 3-5. FIG. 3 illustrates a first position of lock actuator 20 of lock mechanism 16, wherein each arm 30 is at a first limit of travel in first channel 36 (and second channel 40) and is pivoted about pivot 31 in a first angular direction 62 with respect to toothed rack 24 of lock actuator 20 so as to be geometrically locked at the first limit of travel. In this first position of lock actuator 20, the locking elements 12 are in an extended, locked position relative to elongate housing 14.

FIG. 4 illustrates an intermediate position of lock mechanism 16, wherein pin 43 of arm 30 has been moved in first and second channels 36 and 40 by appropriate turning of gear wheel 22 of cylinder lock 18. Movable linkage elements 38 and locking elements 12 have been moved inwards, as indicated by arrows 61.

FIG. 5 illustrates a second position of lock actuator 20, wherein each arm 30 is at a second limit of travel in first channel 36 (and second channel 40) and is pivoted about pivot 31 in a second angular direction 64 with respect to toothed rack 24 of lock actuator 20 so as to be geometrically locked at the second limit of travel. In this second position of lock actuator 20, the locking elements 12 are in a retracted, unlocked position relative to elongate housing 14.

Figure 6:
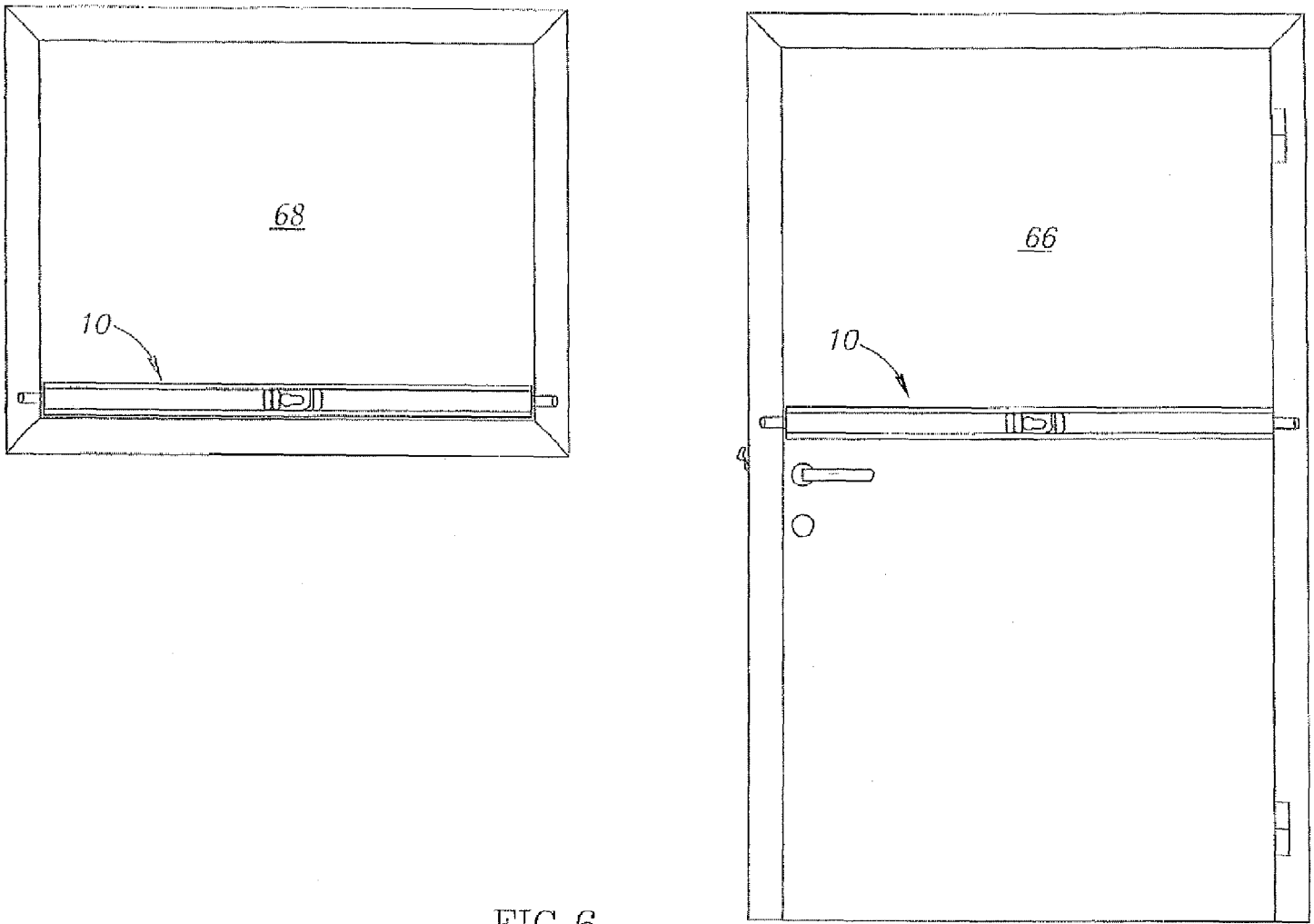
FIGS. 6 and 7 are simplified pictorial illustrations of the multipoint lock of FIG. 1, locking a door and window in horizontal and vertical orientations, respectively.
Figure 7:
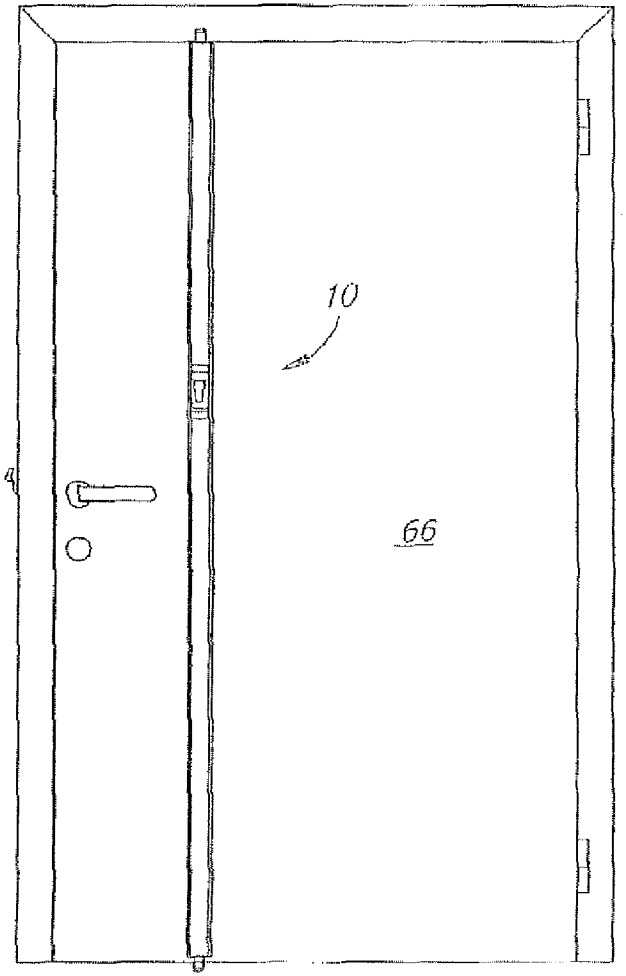
Figure 7:
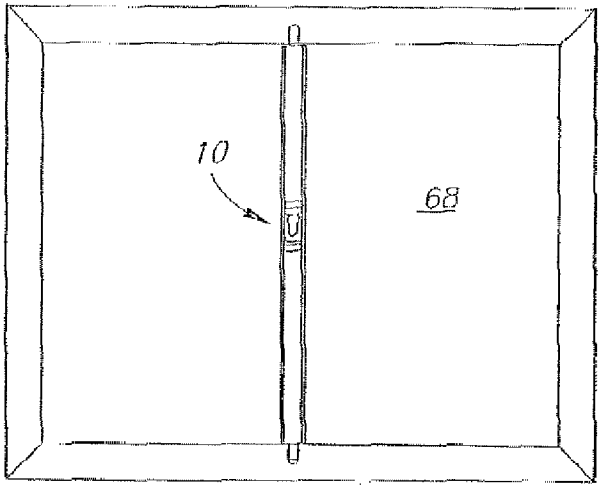

Reference is now made to FIGS. 6 and 7, which illustrate multipoint lock 10 locking a door 66 and window 68 in horizontal and vertical orientations, respectively. It is appreciated that multipoint lock 10 may be used to lock any kind of door, safe, window, patio, garage, store, warehouse, vehicle and the like.

The present invention may enable extending locking elements 12 to a plurality of lengths, as is now described.

Figure 8:
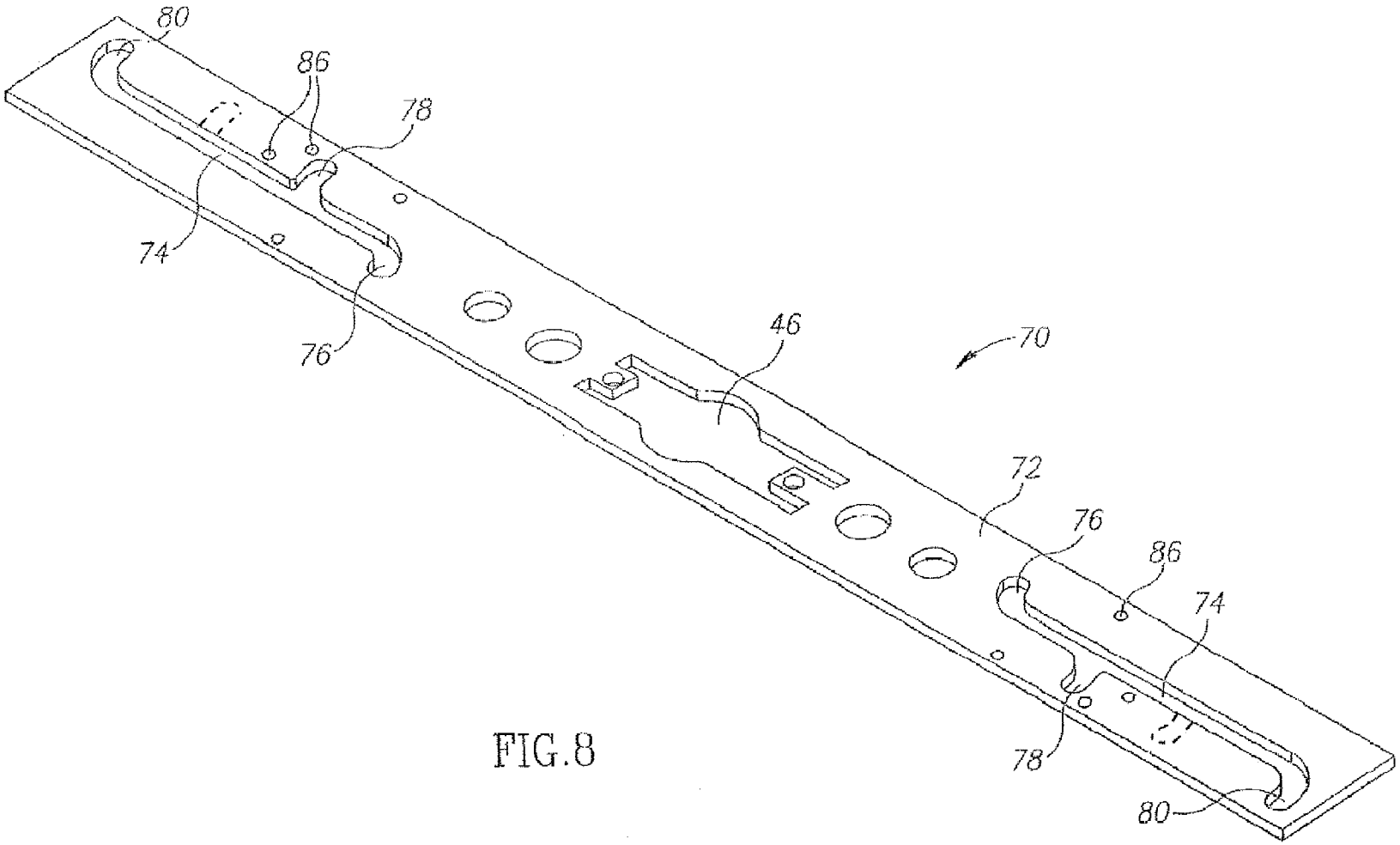
FIG. 8 is a simplified pictorial illustration of a linkage device with channels formed therein that enable extending locking elements from the multipoint lock at a plurality of lengths, constructed and operative in accordance with an embodiment of the present invention.

Reference is now made to FIG. 8, which illustrates another linkage device 70, which may be used in place of linkage device 32 described hereinabove. In this embodiment, linkage device 70 may comprise a stationary linkage element 72 with a channel 74 formed therein on either side of opening 46. Channel 74 may comprise an inner terminus 76 (closer to opening 46), at least one intermediate terminus 78 and an outer terminus 80. Pin 43 of arm 30 (omitted for clarity in FIG. 8) may move in channel 74 as described hereinabove for channel 36.

Figure 9B:
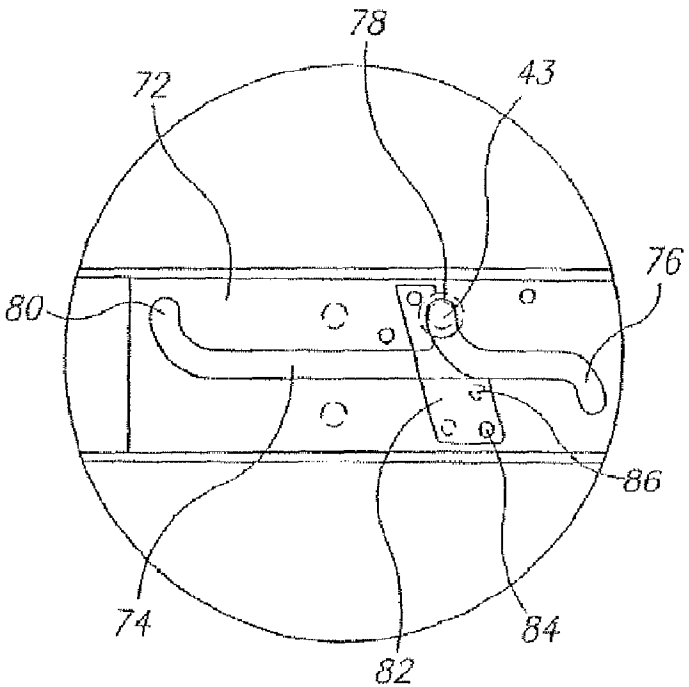
FIG. 9B is a simplified pictorial illustration of a blocking element used in conjunction with the channels of the linkage device so that an arm is constrained to travel in a first, relatively short path in the channels, in accordance with an embodiment of the present invention.
Figure 9A:
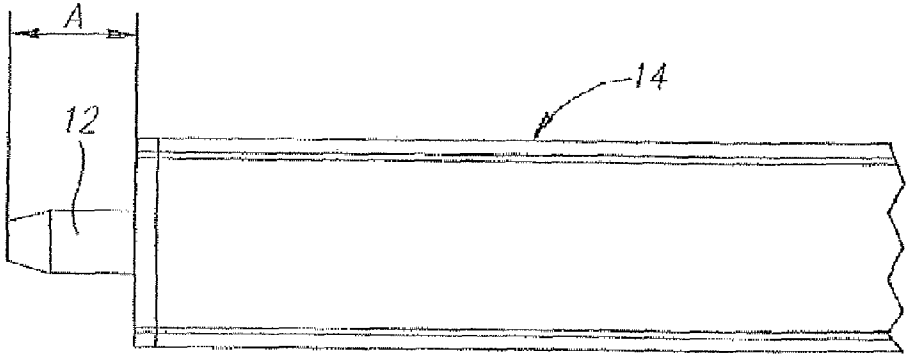
FIG. 9A is a simplified pictorial illustration of the locking element at a first, relatively short extended length.

Reference is now made to FIGS. 9A and 9B. (FIGS. 9A and 9B illustrate the left side channel 74 in the sense of FIG. 8, but it is appreciated that the description is similar for the right side channel 74 as well.)

A blocking element 82 may be attached to linkage element 72, such as but not limited to, by means of fasteners 84 (e.g., screws or rivets) that fasten to mounting holes 86 formed in linkage element 72. Blocking element 82 may be formed of sheet metal, plastic and the like. In the position shown in FIG. 9B, blocking element 82 permits pin 43 to travel between inner terminus 76 and intermediate terminus 78, but blocks travel of pin 43 beyond intermediate terminus 78 to outer terminus 80. In this manner, pin 43 of arm 30 is constrained to travel in a first, relatively short path in channel 74. Accordingly, the locking element 12 is constrained to extend from elongate housing 14 to a first, relatively short extended length A, as indicated in FIG. 9A.

Figure 10B:
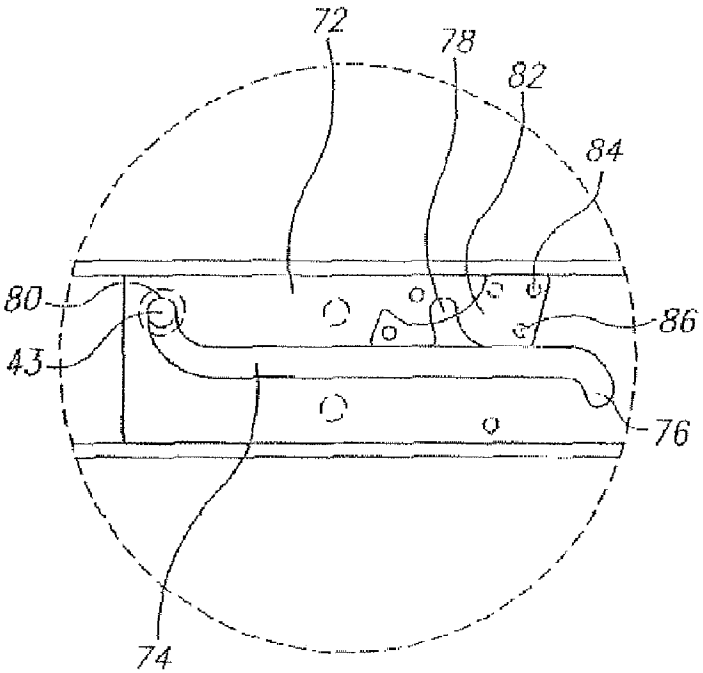
FIG. 10B is a simplified pictorial illustration of the blocking element used in conjunction with the channels of the linkage device so that the arm is constrained to travel in a second, relatively long path in the channels, in accordance with an embodiment of the present invention.
Figure 10A:
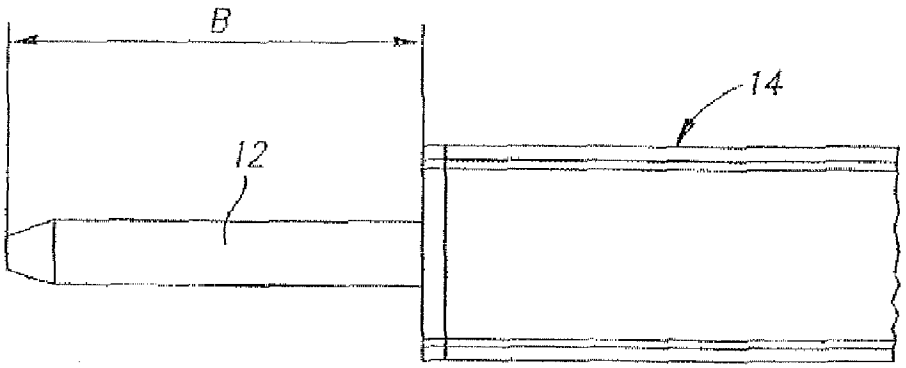
FIG. 10A is a simplified pictorial illustration of the locking element at a second, relatively long extended length.

Reference is now made to FIGS. 10A and 10B. In the position shown in FIG. 10B, blocking element 82 has been re-positioned to permit pin 43 to travel between inner terminus 76 and outer terminus 80, and blocks travel of pin 43 between inner terminus 76 and intermediate terminus 78. In this manner, pin 43 of arm 30 may travel in a second, relatively long path in channel 74. Accordingly, the locking element 12 may extend from elongate housing 14 to a second, relatively long extended length B, as indicated in FIG. 10A.

It is noted that cylinder lock 18 of locking mechanism 16 may be rotated less for the first relatively short extended length A (e.g., one revolution) than for the second relatively long extended length B (e.g., two revolutions).

It is noted that pin 43 (and thus arm 30) may be geometrically locked at inner terminus 76, intermediate terminus 78 and/or outer terminus 80. It is further noted that an installer of multipoint lock 10 has the option of selecting either linkage device 32 or 70, depending if it is desired to provide more than one extended length for locking elements 12.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A multipoint lock comprising:

a locking mechanism adapted to selectively retract and extend at least one locking element relative to an elongate housing, wherein said locking mechanism comprises an arm pivotally attached to a lock actuator and constrained to travel in a channel formed in a linkage device linked to said at least one locking element, wherein said channel comprises at least two terminuses extending from and generally perpendicular to said channel at which said arm is in a locked position and said at least one locking element is at an extended position protruding out of said elongate housing, and wherein said at least one locking element extends further out of said elongate housing with said arm at one of the terminuses than at another of the terminuses, wherein the terminuses of said channel comprise an inner terminus, at least one intermediate terminus and an outer terminus, said outer terminus being closer to an end of said elongate housing than said inner terminus, and wherein said channel is a continuously straight channel from said inner terminus to said outer terminus and said at least one intermediate terminus is generally perpendicular to said continuously straight channel, and wherein said arm is arranged for moving in said channel from said inner terminus to said at least one intermediate terminus and to said outer terminus.

2. The multipoint lock according to claim 1, further comprising a blocking element attached to said linkage device, said blocking element comprising a first position in which said blocking element permits said arm to travel between said inner terminus and said at least one intermediate terminus, and blocks travel of said arm beyond said at least one intermediate terminus to said outer terminus.

3. The multipoint lock according to claim 2, wherein said blocking element comprises a second position in which said blocking element permits said arm to travel between said inner terminus and said outer terminus, and blocks travel of said arm between said inner terminus and said at least one intermediate terminus.

4. The multipoint lock according to claim 1, wherein said arm is geometrically locked at a position along said channel.

5. The multipoint lock according to claim 1, wherein said arm is geometrically locked at least one of said terminuses.

* * * * *